US005927290A

United States Patent [19]

Thiruppathi

[11] Patent Number: 5,927,290

[45] Date of Patent: Jul. 27, 1999

[54] LIQUID DISPENSING HAIR BRUSH

[76] Inventor: Devaraj Thiruppathi, 4825 Beverly Ave., NE., Canton, Ohio 44714

[21] Appl. No.: 09/119,062

[22] Filed: Mar. 9, 1998

Related U.S. Application Data

[63] Continuation-in-part of application No. 08/822,777, Mar. 21, 1997, abandoned.

[51] Int. Cl.[6] ..... A45D 24/28

[52] U.S. Cl. ..... 132/116; 401/140

[58] Field of Search ..... 132/112, 113, 132/114, 115, 116; 401/28, 140, 277, 189, 190, 179, 188 R

[56] References Cited

U.S. PATENT DOCUMENTS

| | | | |
|---|---|---|---|
| Re. 25,585 | 5/1964 | Birch et al. | 132/116 |
| 1,891,471 | 12/1932 | Fotza | 132/116 |
| 2,235,637 | 3/1941 | Hickey | 132/116 |
| 2,381,048 | 8/1945 | Habostad | 132/114 |
| 3,137,305 | 6/1964 | Jones | 132/116 |
| 3,721,250 | 3/1973 | Walter et al. | 132/16 |
| 3,960,160 | 6/1976 | Hogan | 132/112 |
| 3,964,501 | 6/1976 | Matchett | 132/112 |
| 4,055,195 | 10/1977 | Moses | 132/115 |
| 4,254,738 | 3/1981 | Stanley | 132/112 |
| 5,622,192 | 4/1997 | Chiou | 132/112 |
| 5,725,130 | 3/1998 | Kluge et al. | 132/112 |

*Primary Examiner*—Todd E. Manahan
*Attorney, Agent, or Firm*—Sand & Sebolt

[57] ABSTRACT

A liquid dispensing hair brush includes a body having a chamber therein. The hair brush includes a liquid container in the chamber. A trigger is also contained within the chamber. The trigger may be depressed such that it drives the liquid container relative to the body. A pump is disposed in the container that dispenses liquid from the container through a spray nozzle when the container is driven by the trigger. The pump and container are disposed in the head portion of the brush such that the pump stroke may be relatively short. The container may be removable and replaceable or refillable.

18 Claims, 11 Drawing Sheets

LIQUID DISPENSING HAIR BRUSH

CROSS REFERENCE TO RELATED APPLICATIONS

This application is a continuation-in-part application of U.S. Utility patent application Ser. No. 08/822,777 filed on Mar. 21, 1997, now abandoned the disclosures of which are incorporated herein by reference.

BACKGROUND OF THE INVENTION

1. Technical Field

This invention relates generally to hair brushes and more particularly to a hair brush having a mechanism that allows the user of the hair brush to spray a liquid from the hair brush out from the bristle area of the hair brush. Specifically, the present invention is directed to a hair brush having a spray nozzle that is in fluid communication with a liquid pump, the liquid pump being in fluid communication with a liquid container that is moved with respect to the pump when a trigger in the handle of the hair brush is depressed causing liquid from the container to exit the hair brush through the spray nozzle.

2. Background Information

The medical and cosmetic industry has developed many products that may be used to apply liquid to the hair or the scalp. The demand for these products is growing in recent times due to the increased concern about the way people perceive themselves and the growth of the hair loss prevention industry. The hair growth stimulation industry has also increased the demand for devices that apply a liquid to the hair or the scalp. Although some products may be applied to the hairs themselves, other products require that they be applied directly to the scalp.

One method of applying a liquid directly to the scalp is to spray the liquid onto the desired area of scalp and rub it in with one's hands. This method is often messy and inconvenient. Another method of delivering liquid to the scalp is to place the liquid in a container having a relatively long spout. The person then squeezes the container with the spout adjacent the scalp so that the liquid is applied directly to the scalp. One problem with this type of application is that the liquid often runs off of the scalp before it can be rubbed into the scalp by the person's hands.

It is thus desired in the art to provide a device that applies a liquid directly to the hair or the scalp while it is being rubbed into the scalp or the hair. It is also desirable that such a device fits into the surroundings without being awkwardly shaped and without having abnormal extensions protruding from it. As such, it is desirable that the product takes on the appearance of an everyday hair brush such that it may be used in public without drawing unwanted attention to the use of the product.

Such a device may also be used to add plain water to the hair during brushing. Wet hair is generally easier to brush or comb and allows the person brushing the hair to have more control over the position of the hair. A brush that has the water contained within its body is thus desirable.

SUMMARY OF THE INVENTION

In view of the foregoing, it is an objective of the present invention to provide a liquid dispensing hair brush that has the outward appearance of a normal, everyday hair brush.

Another objective of the present invention is provide a liquid dispensing hair brush that is capable of dispensing a liquid onto a person's hair or scalp.

Still another objective of the present invention is provide a liquid dispensing hair brush that dispenses liquid from the bristle area of the hair brush upon the depression of a trigger in the handle of the hair brush.

Yet another objective of the present invention is provide a liquid dispensing hair brush that allows the concentration and spray pattern of the liquid to be varied.

A further objective of the present invention is provide a liquid dispensing hair brush that utilizes a refillable liquid cartridge.

Still a further objective of the present invention is provide a liquid dispensing hair brush that utilizes a replaceable, disposable liquid cartridge.

Yet a further objective of the present invention is provide a liquid dispensing hair brush having a stationary spray nozzle so that the liquid may be precisely applied.

Another objective of the present invention is provide a liquid dispensing hairbrush having a vibrator that allows the user to selectively message his scalp with the hair brush while brushing his hair or dispensing liquid.

Another objective of the present invention is provide a liquid dispensing hair brush that positions the liquid close enough to the spray nozzle so that a manual pump with a relatively short pump stroke may be used to eject the liquid from the spray nozzle.

Another objective of the present invention is provide a liquid dispensing hair brush that utilizes a collapsible and expandable air sac to dispense the liquid from the hair brush.

Another objective of the present invention is to provide a liquid dispensing hair brush that utilizes a liquid container that is separate from the pump and the trigger such that the liquid container may be easily and inexpensively replaced when in is empty.

Another objective of the present invention is to provide a liquid dispensing hair brush that is of simple construction, which achieves the stated objectives in a simple, effective, and inexpensive manner, in which solves the problems and which satisfies the needs existing in the art.

These and other objectives of the present invention are achieved by the improved liquid dispensing hair brush, the general nature of which may be stated as including a body having a chamber; a liquid container carried by the body in the chamber; a pump connected to the liquid container; a spray nozzle carried by the body, the spray nozzle being in fluid communication with the pump; trigger means for moving the pump and the liquid container together as a unit to dispense liquid from the liquid container through the spray nozzle.

BRIEF DESCRIPTION OF THE DRAWINGS

The preferred embodiments of the invention, illustrative of the best modes in which the applicant has contemplated applying the principles of the invention, are set forth in the following description and are shown in the drawings and are particularly and distinctly pointed out and set forth in the appended claims.

Similar numbers refer to similar parts throughout the specification.

DESCRIPTION OF THE PREFERRED EMBODIMENTS

Figure 1:
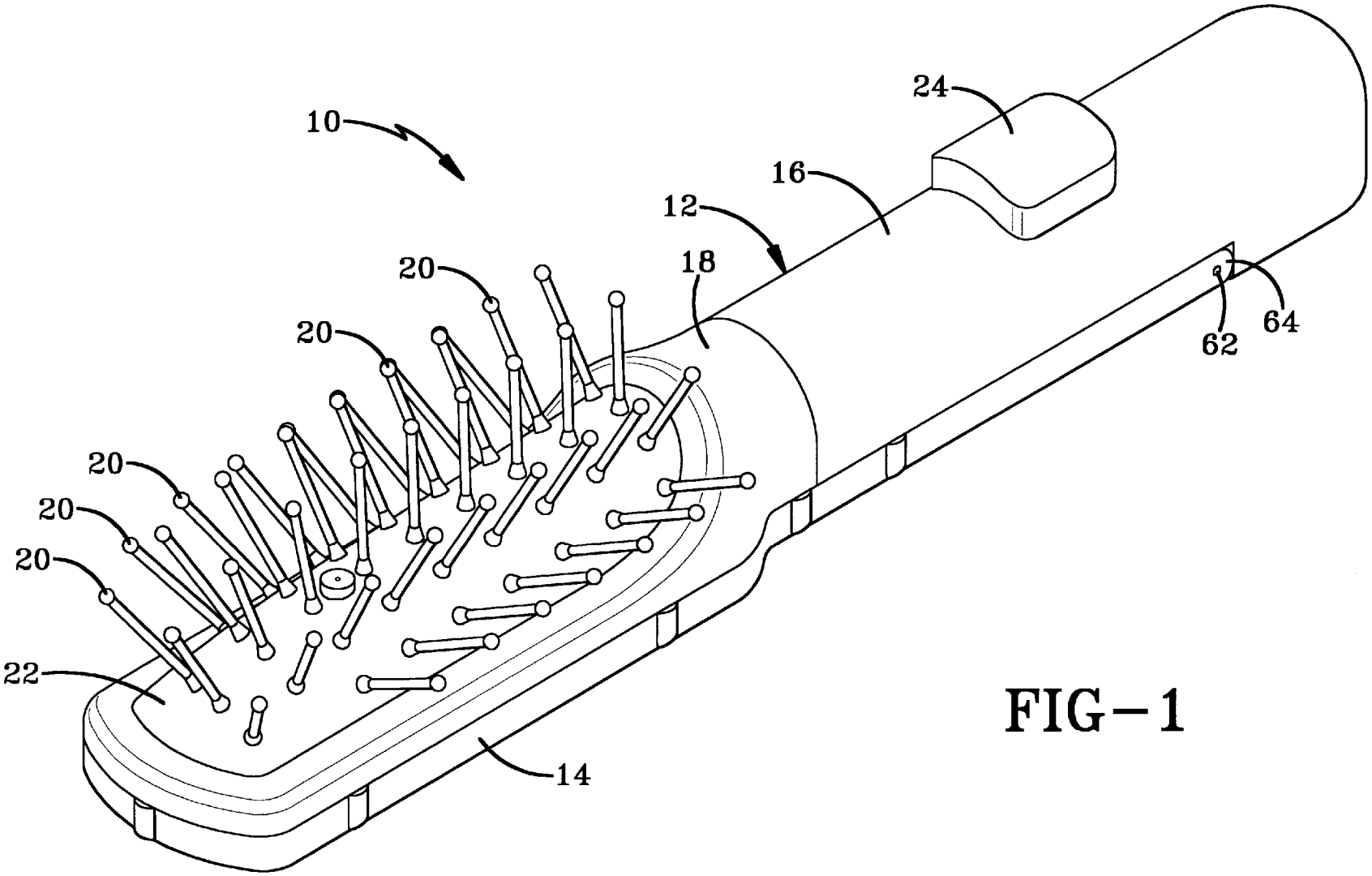
FIG. 1 is a perspective view of a liquid dispensing hair brush according to the concepts of the present invention.
Figure 2:
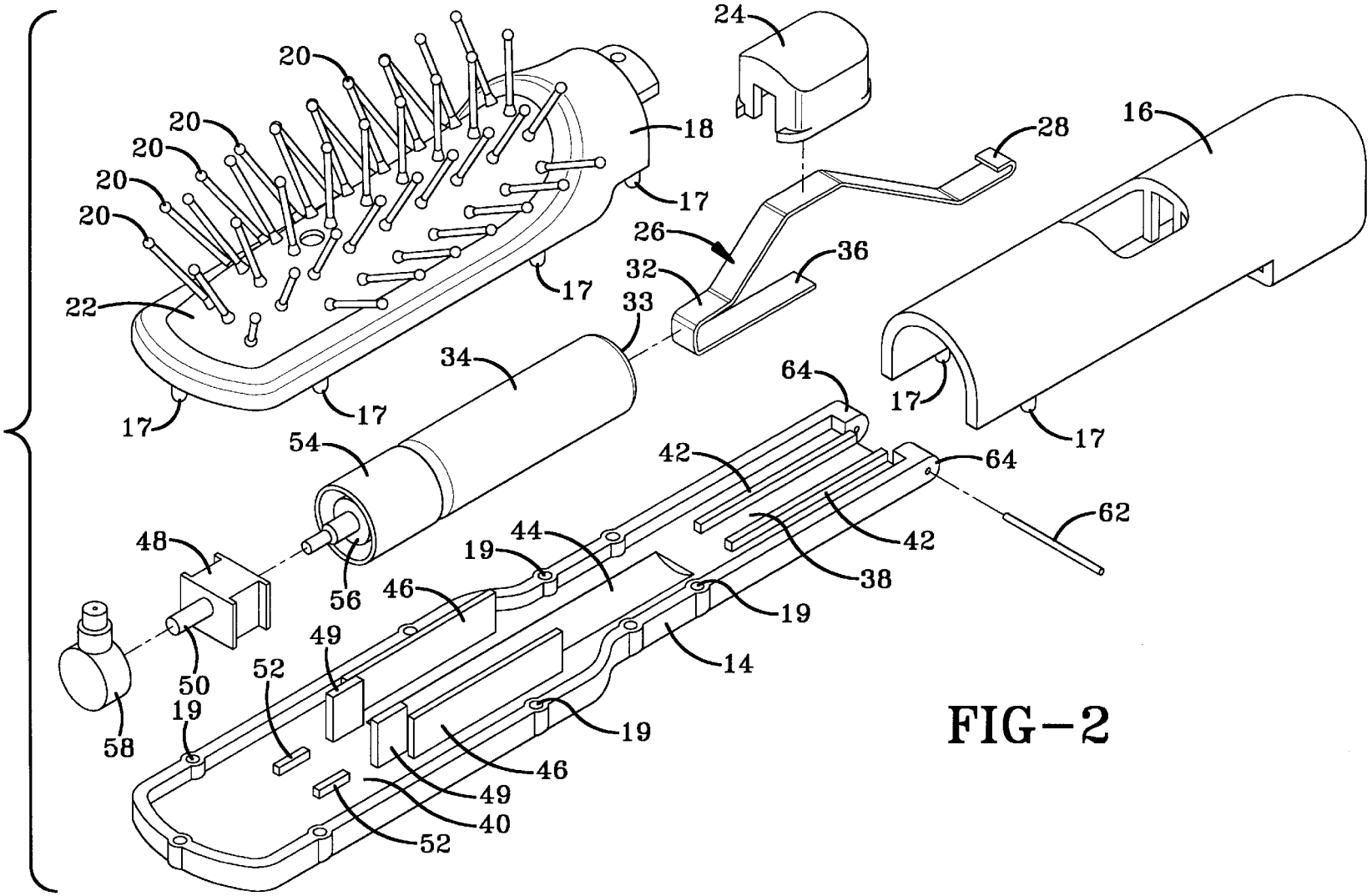
FIG. 2 is an exploded perspective view of the liquid dispensing hair brush.
Figure 3:
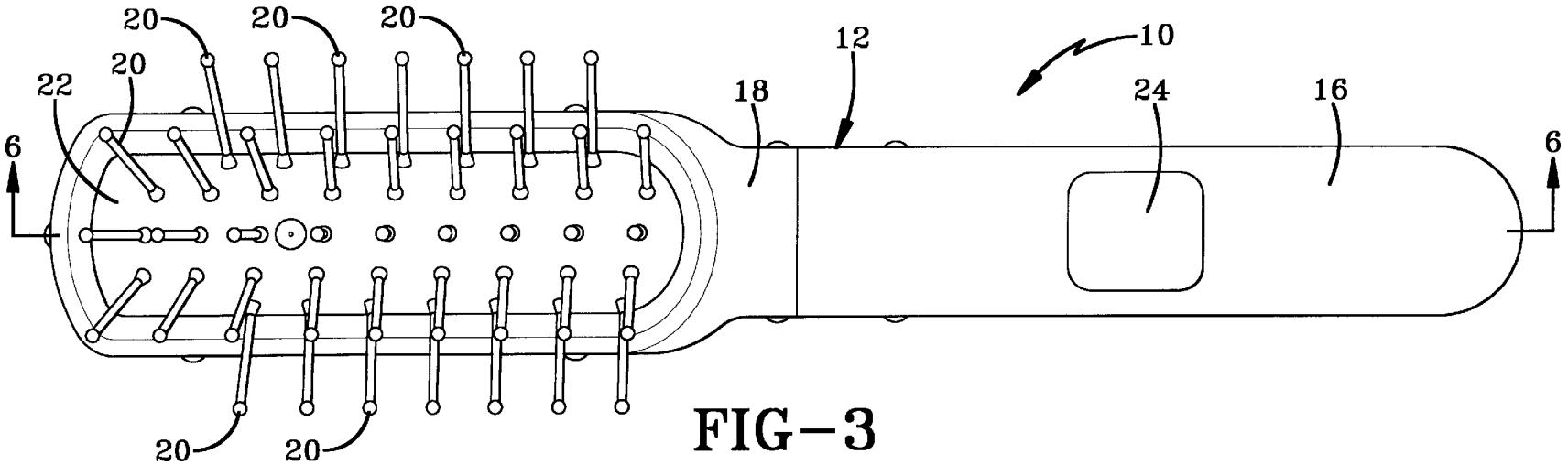
FIG. 3 is a top plan view of the liquid dispensing hair brush of FIG. 1.
Figure 4:
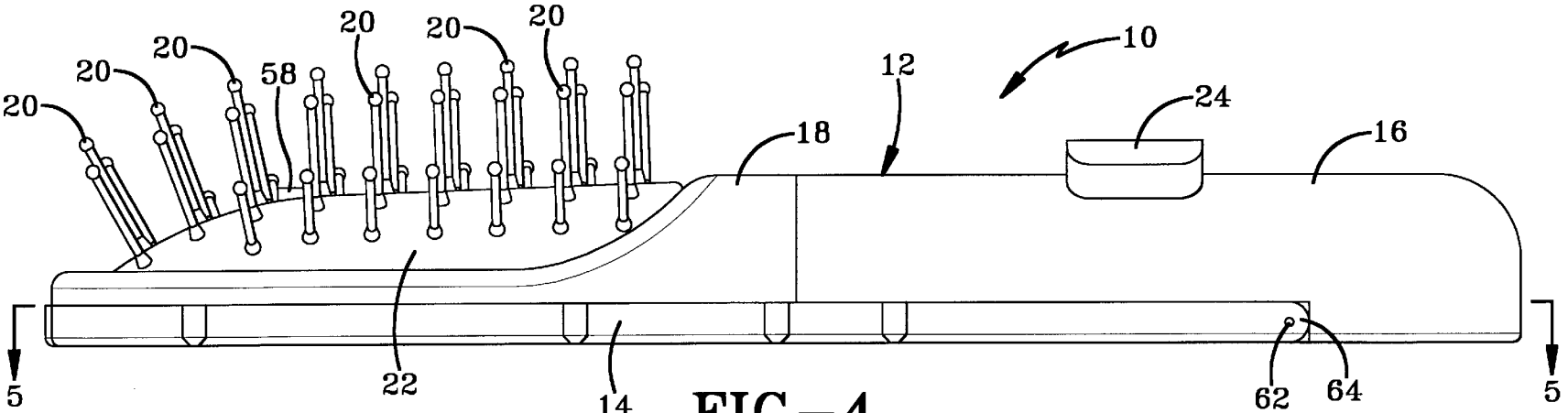
FIG. 4 is a side elevational view of the hair brush of FIG. 3.
Figure 5:
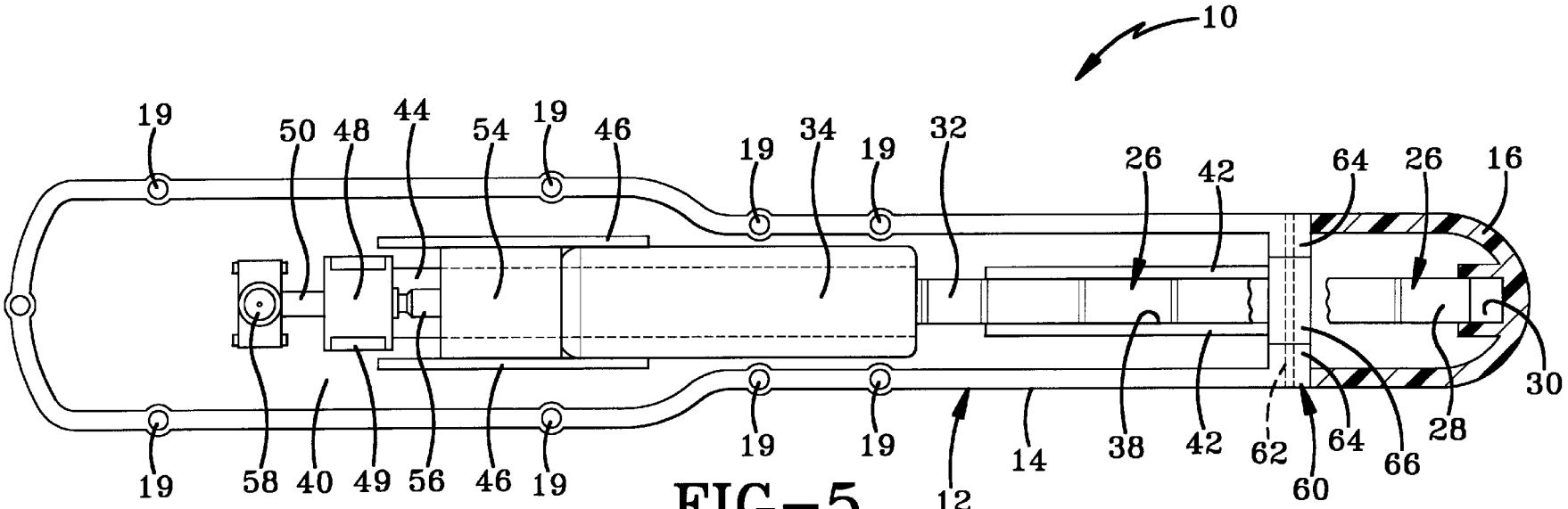
FIG. 5 is a sectional view taken substantially along line 5—5 of FIG. 4.
Figure 6:
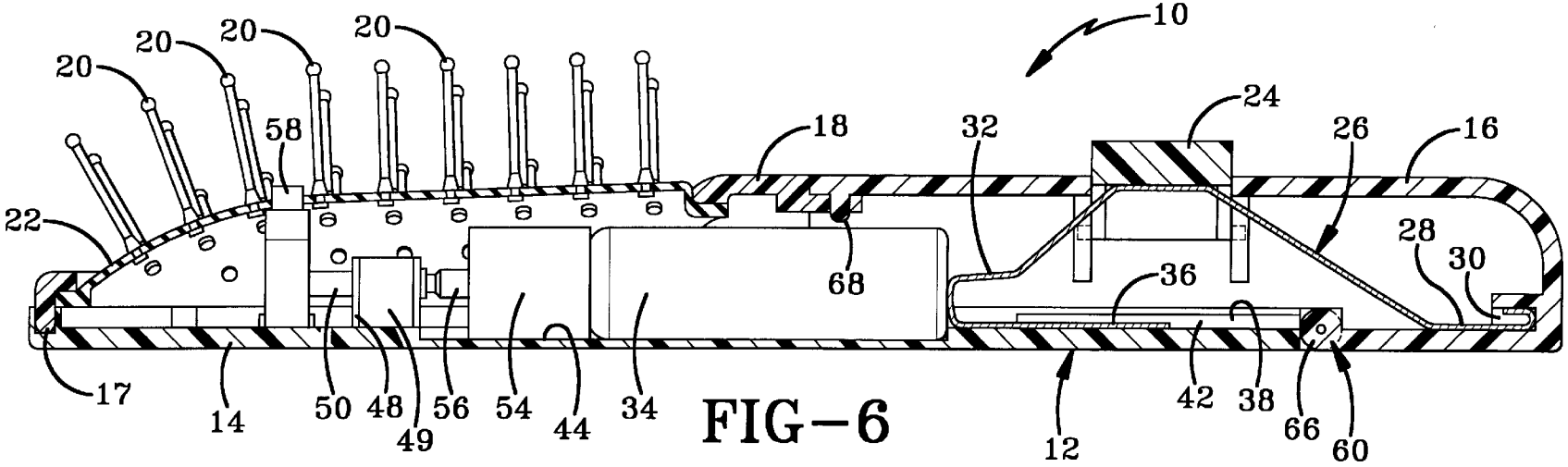
FIG. 6 is a sectional view taken substantially along line 6—6 of FIG. 3 with the trigger and liquid container in the resting position.
Figure 7:
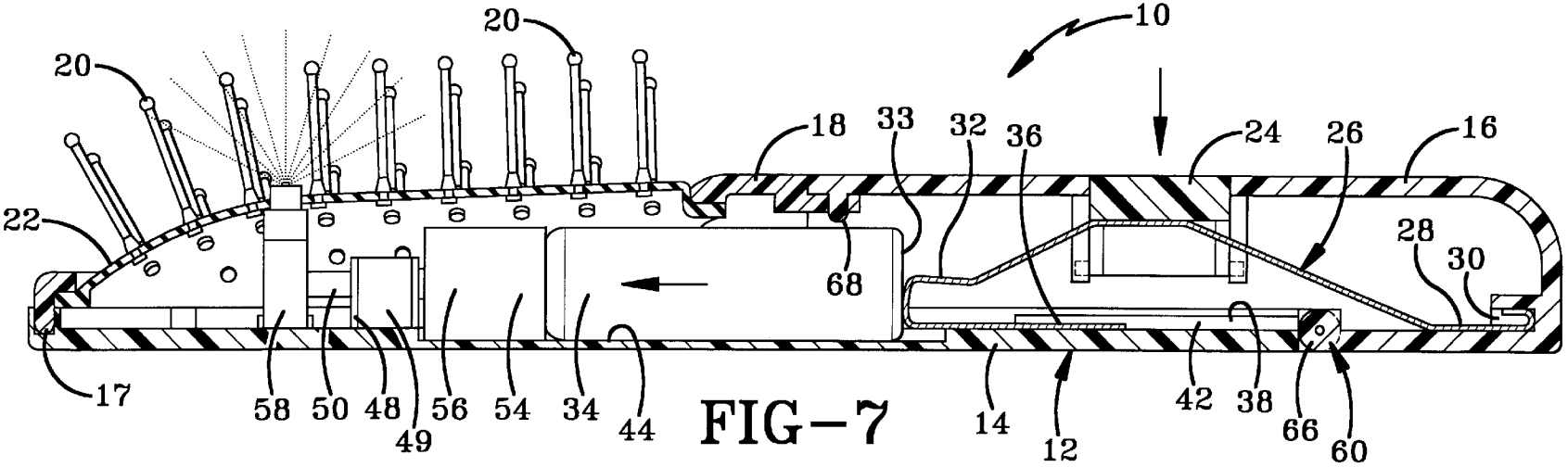
FIG. 7 is a sectional view substantially similar to FIG. 6 with the liquid container and trigger in the dispensing position.

A first embodiment of a liquid dispensing hair brush is depicted in FIGS. 1–7 and is indicated generally by the numeral 10. Hair brush 10 has a body, indicated generally by the numeral 12, that may be fabricated from a suitable plastic, metal, wood, or other rigid material. Body 12 includes a base 14, a handle 16, and a bristle frame 18. As may be seen in FIG. 1, base 14, handle 16, and bristle frame 18 fit together tightly to form a body having a substantially solid appearance that substantially approximates the appearance of a normal, everyday hair brush. In one embodiment of the present invention, handle 16 and bristle frame 18 are connected to base 14 by a plurality of pins 17 that are snugly received in pin receptacles 19. A plurality of bristles 20 extend from a flexible member 22 held in bristle frame 18.

Figure 13:
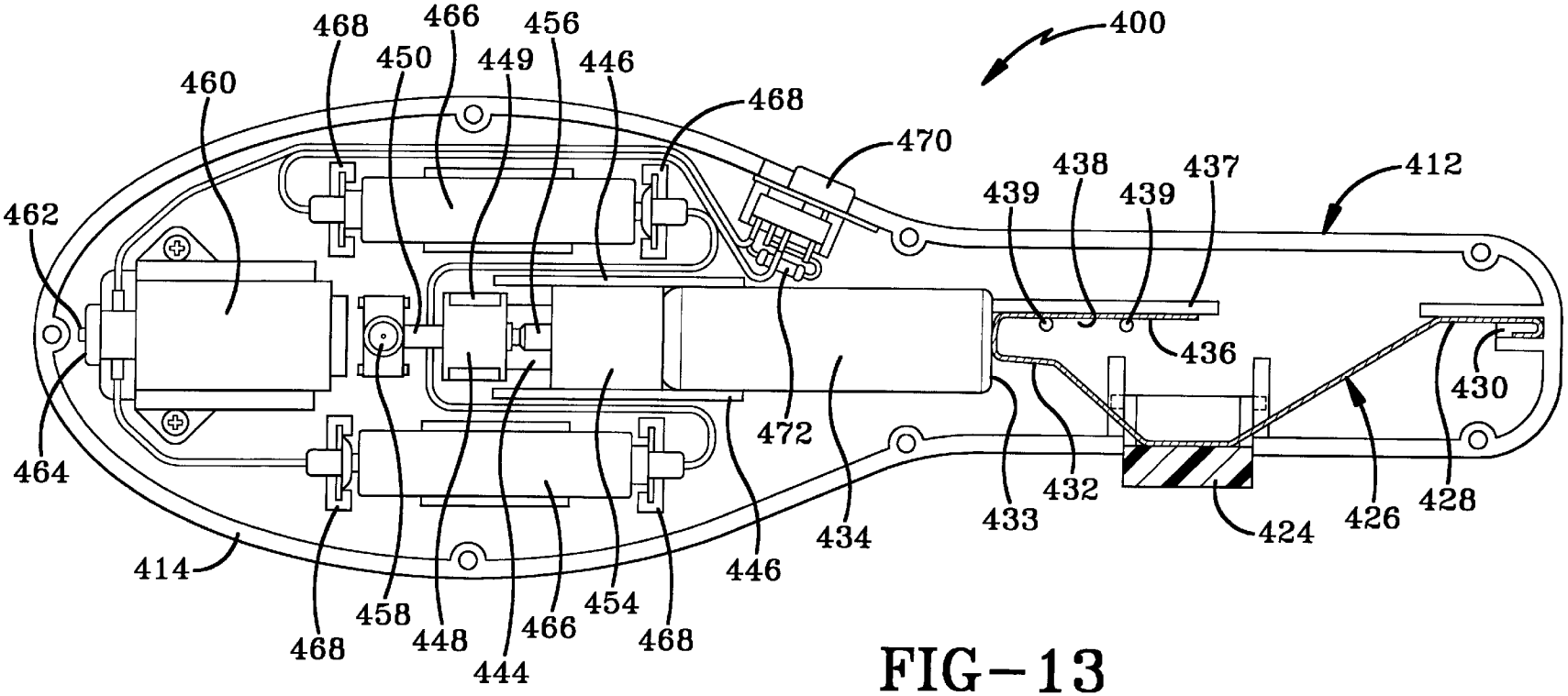
FIG. 13 is a top plan view of a sixth embodiment of a liquid dispensing hair brush with the upper elements of the hair brush removed so that the inner elements may be viewed.

A button 24 is movably carried by handle 16 in a location that is convenient for a person to depress while holding brush 10 in one hand. Button 24 may be disposed on the top surface of handle 16 as depicted in FIG. 1 or may be disposed on the side of handle 16 as depicted in FIG. 13. In either location, button 24 may be depressed by the palm of the hand, by the thumb, or by a finger. Button 24 is movably carried on a flexible trigger.

The rear end 28 of trigger 26 is anchored in a slot 30 formed inside the end of handle 16. The front end 32 of trigger 26 abuts the rear end 33 of a liquid container 34. Trigger 26 further includes a slide portion 36 that is slidably received in a channel 38 formed in the bottom wall 40 of base 14 between a pair of channel walls 42. As may be seen in FIGS. 6 and 7, trigger 26 is resilient such that it flexes when button 24 is depressed. When trigger 26 flexes in response to the depression of button 24, trigger 26 is urged against handle 16 and liquid container 34 such that it drives liquid container 34 towards the front of hair brush 10. Trigger 26 is resilient such that when button 24 is released, trigger 26 returns to the resting position depicted in FIG. 6. In the preferred embodiment of the present invention, trigger 26 may be fabricated from a resilient metal such as spring steel. In other embodiments of the present invention, any of a variety of resilient materials may be used to form trigger 26.

Liquid container 34 is slidably received in a groove 44 formed in bottom wall 40 of base 14. A pair of container sidewalls 46 are disposed on either side of groove 44 to maintain the position of liquid container 34 in hair brush 10. Trigger 26 is not part of liquid container 34 such that container 34 may be removed from hair brush 10 without changing trigger 26. A block 48 having a delivery pipe 50 therethrough is anchored to base 14 by a pair of block anchors 49 that may be integrally formed in base 14. Liquid container 34 has a removable lid 54 in which a pump 56 is disposed. Lid 54 and pump 56 seal liquid container 34 such that liquid may only exit container 34 through pump 56 and delivery pipe 50. A spray nozzle 58 is connected to delivery pipe 50 and is positioned between a pair of retainers 52 that may be integrally formed in base 14. Spray nozzle 58 protrudes through flexible member 22 such that liquid ejected from spray nozzle 58 is dispersed through and outwardly from bristles 20.

Hair brush 10 is operated by depressing button 24 which drives trigger 26 into liquid container 34 causing it to move forward in base 14. The forward movement of liquid container 34 drives liquid container 34 against pump 56 causing liquid to be dispensed through spray nozzle 58. The movement of container 34 causes pump 56 to draw and dispense liquid by compressing pump 56 against block 48. The compression and decompression of pump 56 causes liquid to be forced through liquid passageway 50 and out of spray nozzle 58. Pump 56 may be any of a variety of manual pumps known in the art that operate to dispense relatively small amounts of liquid with a short pump stroke. As such, an important aspect of the present invention is that liquid container 34 is positioned relatively close to spray nozzle 58. Container 34 is thus positioned at least partially within the head portion of hair brush 10 so that pump 56 is close to nozzle 58. Liquid container 34 must be positioned relatively close to spray nozzle 58 because the length of travel of pump 56 does not allow liquid to be moved over a great distance from liquid container 34. Thus, the liquid must be fairly close to spray nozzle 58 to allow it to be dispensed by pump 56 with a short pump stroke. As such, liquid container 34 of the present invention is positioned in the forward portion of hair brush 10 and is actually partially disposed beneath flexible member 22 that supports bristles 20. It has been found that an inadequate spray from nozzle 58 results when pump 56 is disposed back in the handle portion of hair brush 10 because the delivery pipe 50 is too long or too thin. A spring in pump 56 drives liquid container 34 rearwardly when the force on button 24 is released.

When liquid container 34 is empty, it may be removed and refilled or replaced with another liquid container 34. Liquid container 34 may be removed by opening handle 16. Handle 16 is hingedly connected to base 14 by hinge 60 which includes a hinge pin 62 received in a pair of hinge blocks 64 in base 14 and a hinge block 66 in handle 16. A snap fit connection 68 holds the front of handle 16 to base 14. It may thus be understood that handle 16 may be swung upwardly and rearwardly on hinge 60 such that liquid container 34 is accessible. Trigger 26 swings upwardly and rearwardly with handle 16 such that trigger 26 is out of the way allowing liquid container 34 to be easily removed and replaced.

Figure 8:
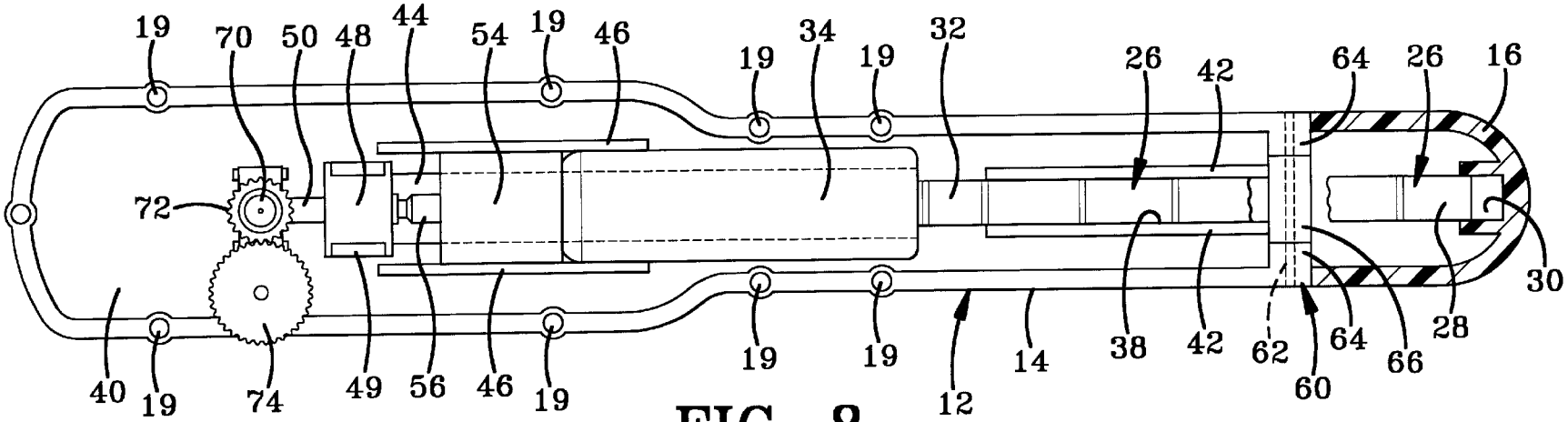
FIG. 8 is a top plan view of a first alternative embodiment of the liquid dispensing hair brush of the present invention with the top surfaces removed to allow the inner elements to be viewed.

A first alternative embodiment of the liquid dispensing hair brush 10 is depicted in FIG. 8. Hairbrush 10 of the first alternative embodiment includes substantially the same elements as the embodiment described in FIGS. 1 through 7 with the difference being that hair brush 10 of the first alternative embodiment includes an adjustable spray nozzle 70. Adjustable spray nozzle 70 may be any of the variety of adjustable spray nozzles known in the art. Adjustable spray nozzle 70 includes an outwardly facing surface having a plurality of gear teeth 72. A thumb gear 74 is rotatably supported on base 14 and engages gear teeth 72 such that rotation of thumb gear 74 causes adjustable spray nozzle 70 to rotate. Adjustable spray nozzle 70 may thus be rotated to provide a fine mist or a narrow stream of liquid when trigger 26 is moved to the dispensing position.

Figure 9:
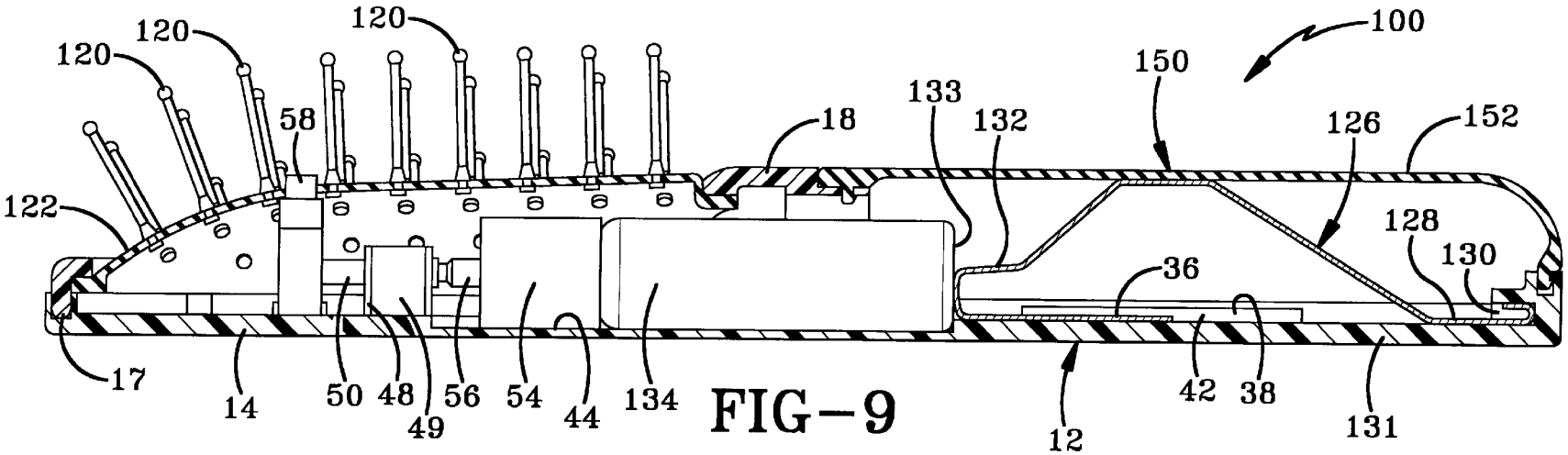
FIG. 9 is a sectional side view of a second alternative embodiment of a liquid dispensing hair brush.

A second alternative embodiment of the liquid dispensing hair brush according to the present invention is depicted in FIG. 9 and is indicated generally by the numeral 100. The operating mechanism of hair brush 100 is substantially similar to the operating mechanism described above with respect to the first embodiment of the present invention. As such, the operating mechanism includes a resilient trigger 126 that is anchored at its rear end 128 in a slot 130 formed in a base member 131. The front end 132 of trigger 126 operatively engages the rear end 133 of a liquid container 134. Front end of trigger 132 may also be operatively connected to an intermediate element (not shown) that extends between rear end 133 of liquid container 134 and front end 132 of trigger 126. The remaining elements of the liquid dispensing system including block 48, pump 56, and spray nozzle 58 are substantially the same as described above with respect to the first embodiment of the present invention and the same numbers have been used in FIG. 9 to indicate these elements.

Hair brush 100 includes base 131 that extends over substantially the entire length of hair brush 100. Base 131 supports a generally flexible member 122 that supports bristles 120. Member 122 is fit into frame 131 in a substantially non-removable fashion.

Hair brush 100 includes a handle 150 that is sized and shaped substantially similar to of a handle of a standard, everyday hair brush. Handle 150 is, however, formed from a generally flexible membrane 152 that is removably connected to base 131. The removable connection allows container 134 to be removed and replaced when the liquid in container 134 is depleted. In other embodiments of the invention, membrane 152 may be permanently connected to base 131. Flexible membrane 152 and trigger 126 are disposed adjacent each other such that trigger 126 may be urged into liquid container 134 through membrane 152. Flexible membrane 152 thus allows a person using hair brush 100 to depress trigger 126 and dispense liquid through spray nozzle 58. Flexible membrane 152 protects the users hands from becoming entangled in trigger 126 and being injured during the operation of hair brush 100. It is to be understood that the configuration of handle 150 may be varied into a variety of shapes that fit differently sized hands and provide different locations for trigger 126.

Figure 10:
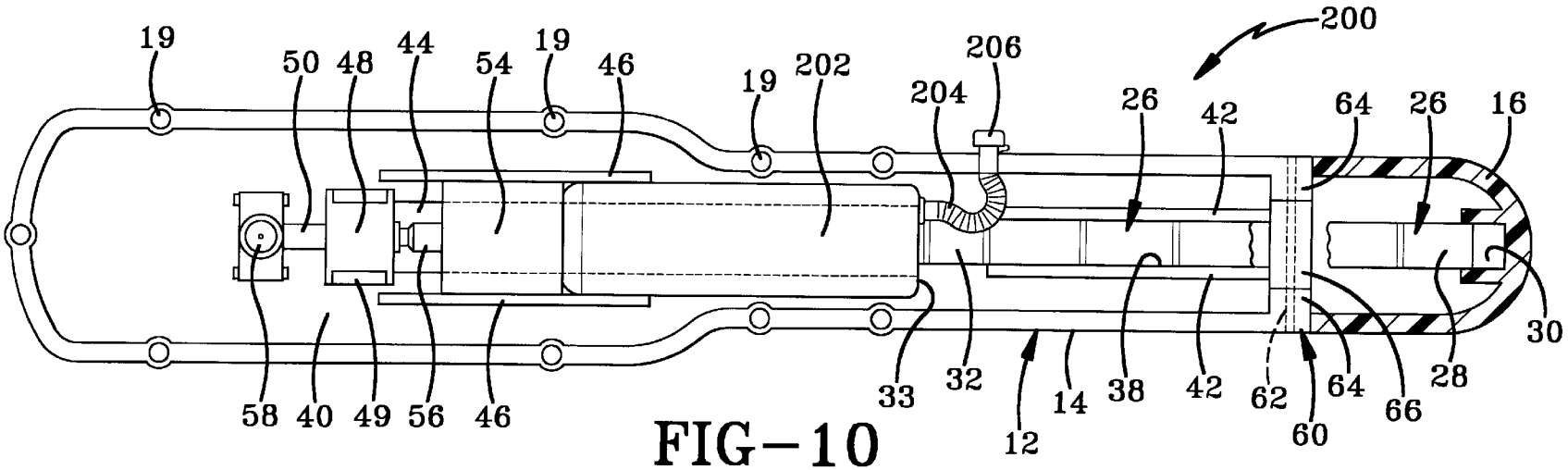
FIG. 10 is a top plan view of a third alternative embodiment of a liquid dispensing hair brush.

A third alternative embodiment of the present invention is depicted in FIG. 10 and is indicated generally by the numeral 200. Hair brush 200 includes substantially the same elements as hair brush 10 described above with reference to FIGS. 1 through 7. Hair brush 200 differs in that it includes a liquid container 202 that is refillable. A fill line 204 is in fluid communication with liquid container 202. Fill line 204 is flexible such that it accommodates the movement of liquid container 202 without leaking. A cap 206 is provided that seals fill line 204 when hair brush 200 is in storage or use. Although fill line 204 is depicted as entering rear surface 33 of liquid container 202, it may be disposed in other locations in other embodiments of the invention.

Figure 11:
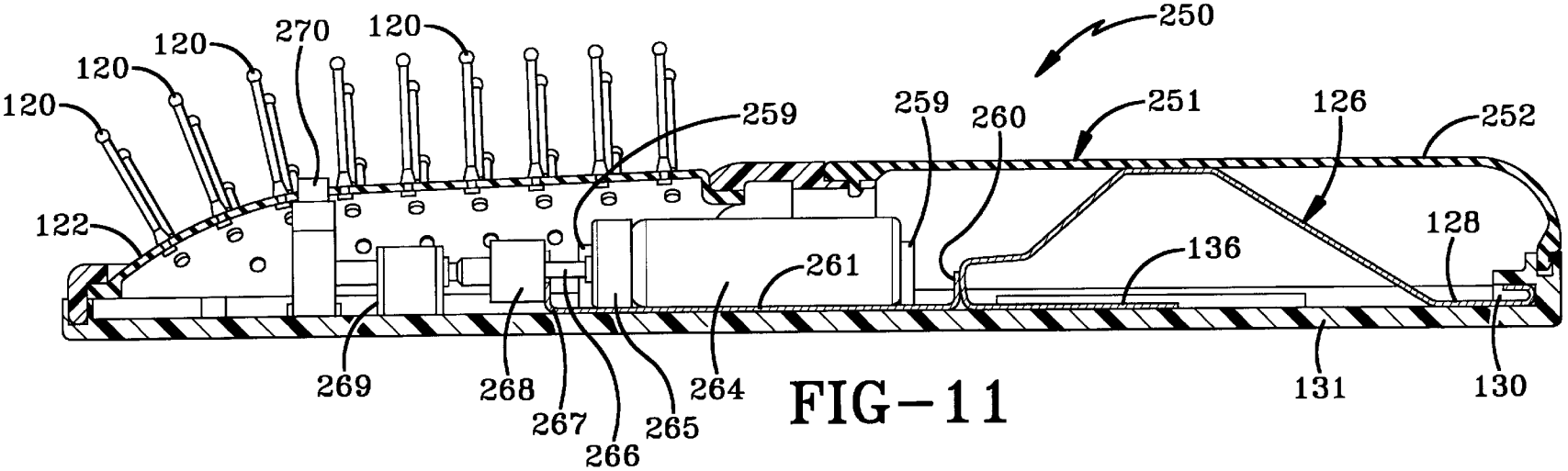
FIG. 11 is a sectional side view of a fourth embodiment of a liquid dispensing hair brush.

A fourth alternative embodiment of the present invention is depicted in FIG. 11 and is indicated generally by the numeral 250. Hair brush 250 includes a base 131 similar to the base described in FIG. 9 above that extends over substantially the entire length of brush 250. Base 131 supports a generally flexible member 122 that supports bristles 120. Member 122 is fit into frame 131 in a substantially non-removable fashion.

Brush 250 includes a trigger 126 that is carried in the handle portion of hair brush 250. The rear end 128 of trigger 126 is anchored in a slot 30 formed inside the end of base 131. The front end 132 of trigger 126 abuts the rear end 260 of a slide 261. Trigger 126 further includes a slide portion 136 that is slidably received on base 131. Slide 261 is slidably disposed adjacent a liquid container 264. Liquid container 264 is non-movably carried by base 131 and includes a cap 265. Container 264 may be held in place by a pair of stops 259. A fluid dispensing pipe 266 passes through cap 265 in a manner that prevents liquid from leaking out of container 264. Pipe 266 may, however, slide back and forth through cap 265. Such a connection may be accomplished by many different ways known in the art. One such way of forming the connection is by providing a gasket in cap 265 of container 264 that snugly engages pipe 266.

The front end 267 of slide 261 rests against a pump 268. Pump 268 is, in turn, abutted against a block 269 such that pump 268 may be driven against block 269 to activate pump 268 causing liquid to be dispensed from container 264. Pump 268 is driven against block 269 by slide 261 in response to the depression of trigger 126.

Hair brush 250 includes a handle 251 that is sized and shaped substantially similar to of a handle of a standard, everyday hair brush. Handle 251 is, however, formed from a generally flexible membrane 252 that is removably connected to base 131. The removable connection allows container 264 to be removed and replaced when the liquid in container 264 is depleted. In other embodiments of the invention, membrane 252 may be permanently connected to base 131. Flexible membrane 252 and trigger 126 are disposed adjacent each other such that trigger 126 may be urged into slide 261 through membrane 252. Flexible membrane 252 thus allows a person using hair brush 250 to depress trigger 126 and dispense liquid through a spray nozzle 270. Flexible membrane 252 protects the users hands from becoming entangled in trigger 126 and being injured during the operation of hair brush 250. It is to be understood that the configuration of handle 251 may be varied into a variety of shapes that fit differently sized hands and provide different locations for trigger 126.

Hair brush 250 is operated by squeezing handle 251 which drives trigger 126 into slide 261 causing it to move forward into pump 268. The forward movement of pump 268 causes liquid to be dispensed through spray nozzle 270. The movement of slide 261 causes pump 268 to draw and dispense liquid by compressing pump 268 against block 269.

Pump 268 may be any of a variety of pumps known in the art that operate to dispense relatively small amounts of liquid when moved a relatively short distance. As such, an important aspect of the present invention is that liquid container 264 is positioned relatively close to spray nozzle 270. Liquid container 264 must be positioned relatively close to spray nozzle 270 because the length of travel of pump 268 does not allow liquid to be moved over a great distance from liquid container 264. Thus, the liquid must be fairly close to spray nozzle 270 to allow it to be dispensed by pump 268 with a short pump stroke. As such, liquid container 268 of the present invention is positioned in the forward portion of hair brush 250 and is actually partially disposed beneath flexible member 122 that supports bristles 120. A spring in pump 268 drives slide 261 rearwardly when the force on trigger 126 is released.

Figure 12:
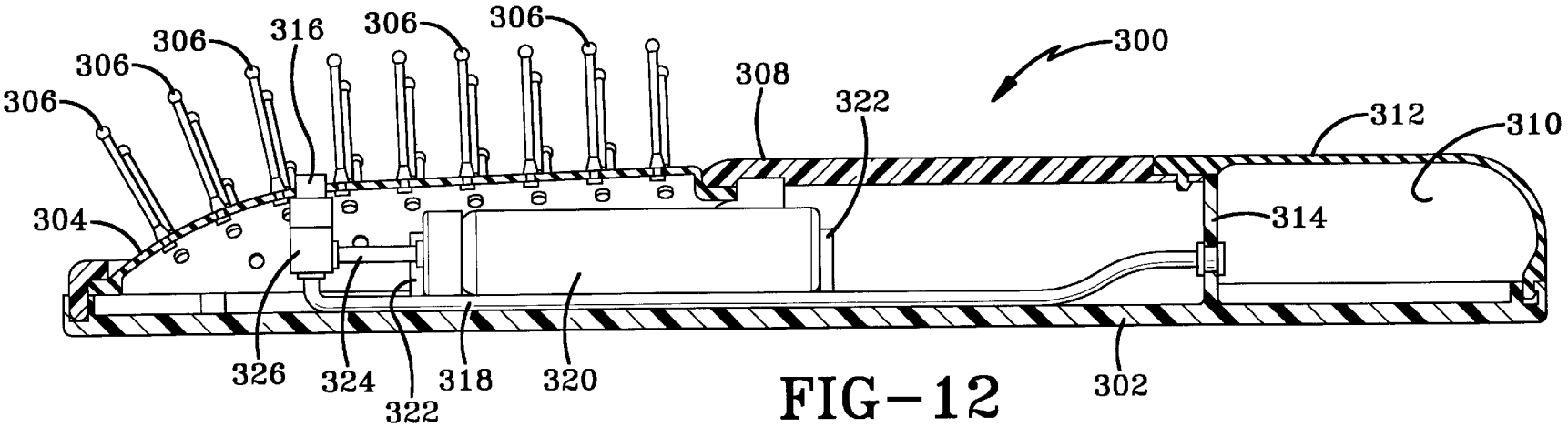
FIG. 12 is a sectional side view of a fifth embodiment of a liquid dispensing hair brush.

A fifth embodiment of the present invention is depicted in FIG. 12 and is indicated generally by the numeral 300. Hair brush 300 includes a base 302 that extends over the entire length of hair brush 300. Base 302 supports a flexible member 304 that carries a plurality of bristles 306. A handle member 308 may cooperate with base 302 to support member 304. Handle member 308 may be selectively removable to allow the user to access the chamber inside hair brush 300.

A collapsible and expandable air sac 310 is formed between base 302 and a flexible button membrane 312. Air sac 310 is abutted at one end by an internal wall 314 that may be integrally formed in base 302. Air sac 310 is in fluid communication with a spray nozzle 316 that is disposed in member 304. An air tube 318 provides the fluid communication between sac 310 and nozzle 316.

A liquid container 320 is carried in hair brush 300 between a pair of stops 322. A liquid dispensing pipe 324 provides fluid communication between container 320 and spray nozzle 316. A valve 326 is disposed between nozzle 316 and tube 318 and pipe 324. Valve 326 allows air and liquid to be dispensed through nozzle 316 when sac 310 is collapsed and expanded. When sac 310 is collapsed, air is forced out of valve 326. Any liquid disposed in valve 326 is also forced out of nozzle 316 as a spray. The pressure on air sac 310 is then released creating a vacuum that draws air back through valve 326 into air sac 310. The vacuum also draws liquid out of container 320 to prime valve 326 for the next time liquid is to be dispensed. Air sac 310 is then collapsed again to spray the liquid out of nozzle 316 and the process is repeated.

Figure 14:
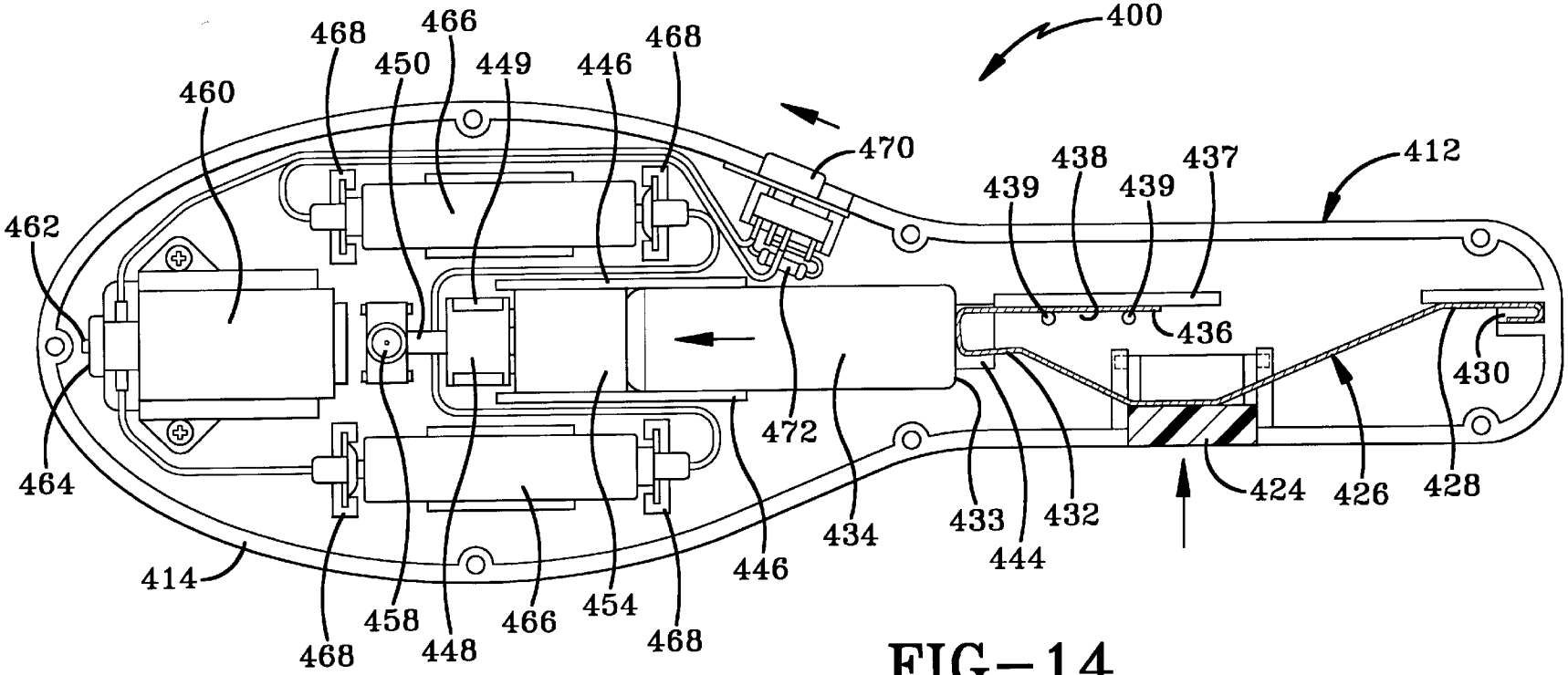
FIG. 14 is a view similar to FIG. 13 with the trigger and liquid container in the dispensing position and the switch for the vibrator in the on position.

The sixth embodiment of a liquid dispensing hair brush is depicted in FIGS. 13 and 14 and is indicated generally by the numeral 400. Hair brush 400 has a body, indicated generally by the numeral 412, that may be fabricated from a suitable plastic, metal, wood, or other rigid material. Body 412 a base 414 that cooperates with a second base member (not shown) that encloses the elements of hair brush 400 and provides support for a plurality of bristles (also not shown).

A button 424 is movably carried by base 414 in a location that is convenient for a person to depress while holding brush 400 in one hand. Button 424 may be disposed on the side surface of base 414 as depicted in the figures or may be disposed in the top of base 412 as depicted in FIGS. 1–7. In either location, button 424 may be depressed by the palm of the hand, the thumb, or by a finger. Button 424 is movably carried on a flexible trigger 426.

The rear end 428 of trigger 426 is anchored in a slot 430 formed inside the end of frame 414. The front end 432 of trigger 426 abuts the rear end 433 of a liquid container 434. Trigger 426 further includes a slide portion 436 that is slidably received in a channel 438 formed between an upstanding member 437 and a pair of pins 439. As may be seen in FIG. 14, trigger 426 is resilient such that it flexes when button 424 is depressed. When trigger 426 flexes in response to the depression of button 424, trigger 426 is urged against base 414 and liquid container 434 such that it drives liquid container 434 towards the front of hair brush 400. Trigger 426 is resilient such that when button 424 is released, trigger 426 returns to the resting position depicted in FIG. 13. In the preferred embodiment of the present invention, trigger 426 may be fabricated from a resilient metal such as spring steel. In other embodiments of the present invention, any of a variety of resilient materials may be used to form trigger 426.

Liquid container 434 is slidably received between a pair of container sidewalls 446 and may be received in a groove 444 similar to the groove depicted in FIGS. 1–7. A block 448 having a delivery pipe 450 therethrough is anchored to base 414 by a pair of block anchors 449 that may be integrally formed in base 414. Liquid container 434 has a removable lid 454 in which a pump 456 is disposed. Lid 454 and pump 456 seal liquid container 434 such that liquid may only exit container 434 through pump 456 and delivery pipe 450. A spray nozzle 458 is in fluid communication with delivery pipe 450 such that liquid may be ejected from spray nozzle 458 when pump 456 is activated.

Hair brush 400 is operated by depressing button 424 which drives trigger 426 into liquid container 434 causing it to move forward in base 414. The forward movement of liquid container 434 drives liquid container 434 against pump 456 causing liquid to be dispensed through spray nozzle 458. The movement of container 434 causes pump 456 to draw and dispense liquid by compressing pump 456 against block 448. The compression and decompression of pump 456 causes liquid to be forced through liquid passageway 450 and out of spray nozzle 458. Pump 456 may be any of a variety of pumps known in the art that operate to dispense relatively small amounts of liquid when moved a relatively short distance. As such, an important aspect of the present invention is that liquid container 434 is positioned relatively close to spray nozzle 458. Liquid container 434 must be positioned relatively close to spray nozzle 458 because the length of travel of pump 456 does not allow liquid to be moved over a great distance from liquid container 434. Thus, the liquid must be fairly close to spray nozzle 458 to allow it to be dispensed by pump 456 with a short pump stroke. As such, liquid container 434 of the present invention is positioned in the forward portion of hair brush 400 and is actually mostly disposed in the head of hair brush 400. A spring in pump 456 drives liquid container 434 rearwardly when the force on button 424 is released.

When liquid container 434 is empty, it may be removed and refilled or replaced with another liquid container 434. Liquid container 434 may be removed by opening body 412 at the seam between base 414 and the upper base member (not shown).

Liquid dispensing hair brush 400 further includes a motor 460 having a shaft 462 that carries a weight 464 off center such that rapid rotation of weight 464 causes motor 460 and thus hair brush 400 to vibrate. Motor 460 is powered by batteries 466 which are held in clips 468. A switch 470 is provided such that motor 460 may be selectively turned on or off. Switch 470 may include a resister 472 and a second position that allows the speed of motor 460 to be varied.

Figure 15:
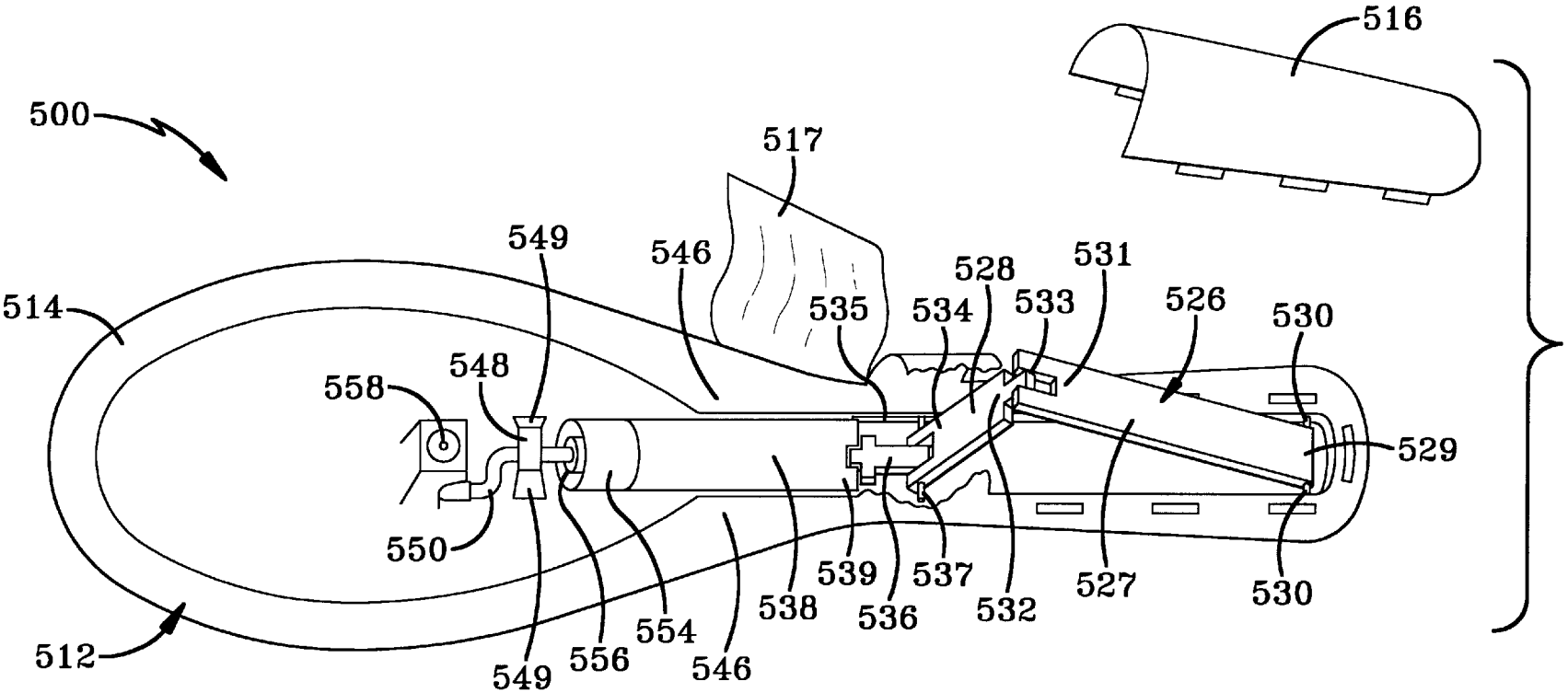
FIG. 15 is a perspective view of a seventh embodiment of the present invention with a portion of the body broken away so that the trigger may be viewed.

A seventh embodiment of the present invention is depicted in FIG. 15 and is indicated generally by the numeral 500. Hair brush 500 has a body, indicated generally by the numeral 512, that may be fabricated from a suitable plastic, metal, wood, or other rigid material. Body 512 includes a base 514, a flexible handle membrane 516, and a neck flap 517. When connected to base 514, membrane 516 allows a person using brush 500 to depress a trigger 526 disposed in the handle portion of the hair brush 500.

Trigger 526 generally includes two elements 527 and 528 that pivot with respect to each other. The rear end 529 of element 527 is pivotally connected to base 514 by an appropriate pin 530. The front end 531 of element 527 is pivotally connected to the rear end 532 of second element 528 by an appropriate pin 533. The front end 534 of second element 528 is slidable received in a pair of grooves 535 formed in base 514 on either side of second element 528.

The second end 534 of second element 528 is pivotally connected to a pusher 536 by an appropriate pin 537. Pusher 536 abuts the rear end 539 of a liquid container 538. It may thus be understood that when trigger 526 is depressed, elements 527 and 528 pivot with respect to each other to drive pusher 536 into liquid container 538.

Liquid container 538 is slidably received in base 514 A pair of container sidewalls 546 are disposed on either side of container 538 to maintain the position of liquid container 538 in hair brush 500. Trigger 526 is not part of liquid container 538 such that container 538 may be removed from hair brush 500 without changing trigger 526. A block 548 having a delivery pipe 550 therethrough is anchored to base 514 by a pair of block anchors 549 that may be integrally formed in base 514. Liquid container 538 has a removable lid 554 in which a pump 556 is disposed. Lid 554 and pump 556 seal liquid container 538 such that liquid may only exit container 538 through pump 556 and delivery pipe 550. A spray nozzle 558 is connected to delivery pipe 550.

Neck flap 517 allows a person to access liquid container 538 in order to replace container 538 after it has been emptied. Hair brush 500 is operated by depressing trigger 526 which drives pusher 536 into liquid container 538 causing it to move forward in base 514. The forward movement of liquid container 538 drives liquid container 538 against pump 556 causing liquid to be dispensed through spray nozzle 558. The movement of container 538 causes pump 556 to draw and dispense liquid by compressing pump 556 against block 548. The compression and decompression of pump 556 causes liquid to be forced through liquid passageway 550 and out of spray nozzle 558.

Accordingly, the improved liquid dispensing hair brush is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the liquid dispensing hair brush is constructed and used, the characteristics of the construction, and the advantageous new and useful results obtained; the new and useful structures, devices, elements, arrangements, parts, and combinations are set forth in the appended claims.

I claim:

1. A liquid dispensing hairbrush, comprising:

a body having a chamber;

a liquid container carried by said body inside chamber;

a pump connected to such liquid container;

a spray nozzle carried by said body, said spray nozzle being in fluid communication with said pump;

a plurality of bristles projecting from said body; and trigger means for moving said pump inside liquid container together as a unit to dispense liquid from said liquid container through said spray nozzle.

2. A liquid dispensing hair brush according to claim 1, wherein said body has a head portion and a handle portion, said spray nozzle being carried by said head portion and said trigger means disposed in said handle portion.

3. A liquid dispensing hair brush according to claim 2, wherein said liquid container is disposed at least partially in said head portion and at least partially disposed in said handle portion.

4. A liquid dispensing hair brush according to claim 2, wherein said trigger means includes a pair of elements pivotally connected to each other and a pusher that abuts said liquid container.

5. A liquid dispensing hair brush according to claim 3, wherein said trigger means includes a resilient trigger movably carried by said body between said body and said liquid container.

6. A liquid dispensing hair brush according to claim 5, further comprising a button carried by said body between first and second positions, said button urging said trigger into said liquid container when said button is in said second position.

7. A liquid dispensing hair brush according to claim 5, further comprising a flexible membrane forming at least a portion of said handle portion, a portion of said flexible membrane disposed adjacent said trigger such that said trigger may be urged against said liquid container by said flexible membrane.

8. A liquid dispensing hair brush according to claim 5 wherein said body includes a base and a handle hingedly attached to said base, said trigger carried in said handle, said trigger being disposed outside said liquid container.

9. A liquid dispensing hair brush according to claim 2 further comprising a delivery pipe disposed between said spray nozzle and said pump, said pump and said liquid container being disposed close to said spray nozzle such that a single pump stroke forces liquid out of said spray nozzle.

10. A liquid dispensing hair brush according to claim 1 wherein said spray nozzle is adjustable.

11. A liquid dispensing hairbrush according to claim 10 further comprising a thumb gear rotatably carried by said body, said thumb gear protruding through said body, said spray nozzle including a plurality of gear teeth disposed on its outer surface, and said thumb gear engaging said gear teeth on said spray nozzle.

12. A liquid dispensing hair brush according to claim 1, wherein said liquid container is replaceable.

13. A liquid dispensing hair brush according to claim 1, wherein said liquid container is refillable.

14. A liquid dispensing hair brush according to claim 13, further comprising a flexible fill tube carried by said body, said fill tube being in fluid communication with said liquid container.

15. A liquid dispensing hairbrush according to claim 14, further comprising a cap selectively attachable to said fill tube, said cap sealing said fill tube when said cap is attached to said fill tube.

16. A liquid dispensing hair brush according to claim 1, further comprising vibration means for selectively causing said body to vibrate.

17. A liquid dispensing hairbrush according to claim 16 wherein said vibration means includes a motor having a shaft and a member connected to said shaft such that rapid rotation of said member causes said body to vibrate.

18. A liquid dispensing hair brush according to claim 17, further comprising at least one battery and a switch connected to said battery, said battery also being connected to said motor, said switch adapted to selectively supply power to said motor.

* * * * *